United States Patent [19]

Ade et al.

[11] 4,143,488

[45] Mar. 13, 1979

[54] FUEL SUPPLY UNIT

[75] Inventors: Rolf Ade; Hans Prohaska, both of Bietigheim-Bissingen; Eckhardt Schmid, Guglingen, all of Fed. Rep. of Germany

[73] Assignee: ITT Industries, Inc., New York, N.Y.

[21] Appl. No.: 801,784

[22] Filed: May 31, 1977

[30] Foreign Application Priority Data

Jul. 15, 1976 [DE] Fed. Rep. of Germany ..... 2631773

[51] Int. Cl.[2] ..... F04B 39/06

[52] U.S. Cl. ..... 417/366; 417/372

[58] Field of Search ..... 417/366, 372; 415/52

[56] References Cited

U.S. PATENT DOCUMENTS

| | | | |
|---|---|---|---|
| 2,845,871 | 8/1958 | Compton | 417/366 X |
| 3,736,075 | 5/1973 | Otto | 417/366 |
| 3,764,236 | 10/1973 | Carter | 417/372 |
| 3,936,243 | 2/1976 | Gakenholz | 417/366 |

*Primary Examiner*—Carlton R. Croyle
*Assistant Examiner*—Richard E. Gluck
*Attorney, Agent, or Firm*—James B. Raden; William J. Michals

[57] ABSTRACT

An automotive fuel pump having a return channel from the pressure side to the suction side thereof, comprising an opening in the housing independent of the outlet channel and opening to the inlet channel. The return channel is located in the area of the pressure side armature bearing. This construction enables elimination of gas bubble formation when the fuel being pumped is warmed.

2 Claims, 2 Drawing Figures

10
23
20
25

18
17
16
21
15
14
20
22
13
10
12
II
II
24
23
11
19
26

FUEL SUPPLY UNIT

BACKGROUND OF THE INVENTION

This invention relates to a fuel supply unit comprising a pump and an electromotor around which the fuel flows. The pump and electromotor are surrounded by a common housing having an inlet channel and an outlet channel, whereby fuel is returned through a return channel from the pressure side to the suction side.

The return channel insures that a certain minimum quantity of fuel flows around the pump and the electromotor if, for example, only a small quantity of fuel is required, as when the vehicle is stopped. In this manner one avoids the formation of gas bubbles in the supplied fuel which would result in a stop of the internal-combustion engine. On the front surface on the pressure side of the housing of so-called inside tank pumps a nozzle is provided from which the quantity of fuel required for cooling flows back into the fuel tank. While this solution is very simple, it can not be applied to outside tank pumps. Until now a return channel of a defined cross-section was provided for outside tank pumps which from the consumption place, for example, from the carburetor of the internal-combustion engine leads back to the fuel tank. This solution is expensive, because in modern vehicles with front engine and fuel tank located above of the rear axle a long return pipe is required which must be corrosion-resistant. Further, the mounting and installation of this return pipe is entailed with difficulties, particularly since a by-pass has to be inserted into the real fuel pipe.

SUMMARY OF THE INVENTION

Substantially simpler in design and therefore less expensive is a solution in which according to the present invention the retun channel has a defined cross-section and originates at an opening on the pressure side of the housing being independent of the outlet channel. Thus the return does not originate at the carburetor, but directly at the fuel supply unit and is consequently considerably shorter, if it is located near the fuel tank. Thereby no by-pass is necessary, in a productionally simple manner an opening independent of the outlet channel is already provided at the housing. The return channel can directly open to the fuel tank, however in order to simplify the installation according to an advantageous development of the invention a solution is suggested in which in direction of flow in front of the pump the return channel opens to the inlet channel. In case the return channel is then not much longer than the fuel supply unit.

A fluid support of the armature shaft on the pressure side end in a simple manner can be achieved in that according to an advantageous development of the invention the return channel originates at the pressure side bearing of the electromotor. Because of reasons of inflow technique the return channel will be axially inserted into the inlet channel, whereby the end of the return channel is arranged at such a spacing from the pump that in spite of the mixing the returned warm fuel with the cold fuel sucked from the fuel tank a sufficient cooling under avoidance of gas bubble formation is ensured. Eventually the return channel according to an advantageous embodiment of the invention inside of the fuel pipe is conducted as far as into the fuel tank itself. The return channel can be formed by a separate piece of pipe which is fastened on the outside of the housing, but a more economical solution is achieved, if according to an advantageous development of the invention the pipe piece is installed inside of the housing. Then the fuel supply unit may be delivered as a unit with the return channel and in a simple way can be inserted between corresponding pipe connections of a fuel pipe.

BRIEF DESCRIPTION OF THE DRAWING

The invention is described below in detail by way of an embodiment shown in the accompanying drawing, in which.

DETAILED DESCRIPTION

Figures 1, 2:
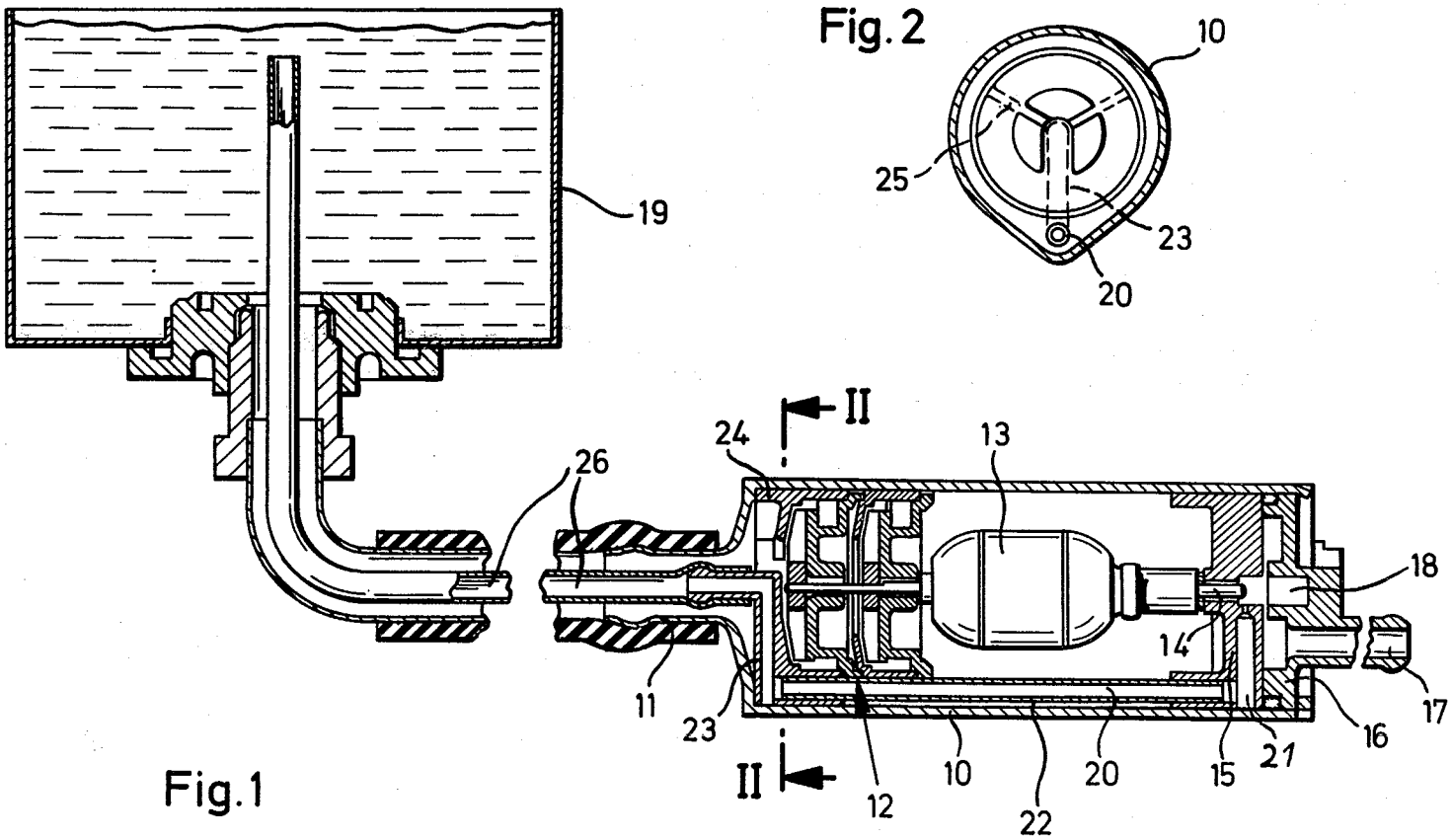
FIG. 1 is a longitudinal sectional view taken through a fuel supply unit in accordance with the principles of the present invention; and, FIG. 2 is a section taken along the line II—II of FIG. 1.

In a tube-shaped housing part 10 comprising an inlet channel 11, a two-stage centrifugal pump 12 is located which is driven by an electromotor 13. The pressure side end of the armature shaft 14 is mounted in a support plate 15. The housing is closed by a cover plate 16 with an outlet channel 17, which adjacent to the front side of the armature shaft is provided with an axial bore 18. The fuel supply unit in known manner operates in a way that by the centrifugal pump from a fuel tank 19 fuel is sucked in and axially flowing around the armature of the electromotor is pressed to the outlet channel 17. A quantity of fuel sufficient for cooling is thereby also pressed along the collector of the electromotor through the pressure side bearing of the armature shaft 14 into the bore 18 of the cover plate 16.

At this bore 18 in radial direction originates a return channel 20, the first part 21 of which can be provided by appropriate shape of the cover plate 16 or also of the support plate 15. The second part 22 of the return channel is formed by a tube which inside of the housing portion 10 is installed alongside of the cylindrical wall. The third part 23, the angled shank of which axially and centrally opens to the inlet channel 11, is made by appropriate design of the pump housing part 24, on which webs 25 are formed for a centric guiding of the portion of the return channel extending into the inlet channel 11. Third part 23 is connected to fourth part 26 which is connected to fuel tank 19.

Thus from the pressure side end of this embodiment a certain minimum quantity of fuel is conducted to the suction side via the bearing of the armature shaft and the return channel, so that even then a reliable cooling is ensured, if only very little fuel flows out of the outlet channel.

In the embodiment shown in the drawing the return channel is extended into the fuel tank by a tubing connection. The cooling is thereby essentially improved, because the warmed up flowing back fuel mixes with the entire quantity of fuel in the tank. Because of the thin cross-section of the return channel a relatively high pressure is created, which effects a vorticity of the returned hot fuel with the cooler fuel in the tank.

What is claimed is:

1. A fuel supply unit for use with and for mounting externally of a fuel tank, said fuel unit comprising:

a housing having an inlet opening for coupling to and communication with said fuel tank and said housing having an outlet opening;

a motor mounted within said housing;

a pump mounted within said housing and operatively coupled to said motor for drawing fuel from said inlet opening, pumping said fuel around said motor, and discharging said fuel through said outlet opening; and, an enclosed return line channel having an inlet opening and an outlet opening said inlet opening of said channel having a cross-sectional area substantially less than the cross-sectional area of said outlet opening of said housing and said inlet opening of said channel being located in said housing between said pump and said outlet opening of said housing wherein said inlet opening of said channel communicates with the discharging fuel, said channel extending into said inlet opening of said housing so that when said housing is coupled to said fuel tank said outlet opening of said channel is in communication with said fuel tank at a point which is spaced-apart from said inlet opening of said housing.

2. The fuel supply unit according to claim 1, wherein the intermediate portion of said channel between said inlet and outlet openings of said housing is entirely enclosed within said housing.

* * * * *